United States Patent [19]

Dismukes

[11] Patent Number: 4,616,719

[45] Date of Patent: Oct. 14, 1986

[54] CASING LATERAL WELLS

[76] Inventor: Newton B. Dismukes, 2952 Buttonwood Dr., Carrollton, Tex. 75006

[21] Appl. No.: 535,990

[22] Filed: Sep. 26, 1983

[51] Int. Cl.[4] ..... E21B 4/04

[52] U.S. Cl. ..... 175/94; 175/107

[58] Field of Search ..... 175/94–97, 175/104–107, 61, 62, 65, 67, 410, 421

[56] References Cited

U.S. PATENT DOCUMENTS

| | | | |
|---|---|---|---|
| 1,831,530 | 11/1931 | Goldsmith | 175/421 |
| 2,251,916 | 8/1941 | Cross | 175/65 X |
| 3,140,748 | 7/1964 | Engle et al. | 175/410 |
| 3,661,218 | 5/1972 | Brown | 175/107 X |
| 3,732,143 | 5/1973 | Joosse | 175/6 X |
| 3,797,589 | 3/1974 | Kellner et al. | 175/94 |
| 3,799,276 | 3/1974 | Matsushita et al. | 175/94 |
| 4,040,495 | 8/1977 | Kellner et al. | 175/107 X |
| 4,143,722 | 3/1979 | Driver | 175/107 X |
| 4,267,893 | 5/1981 | Mannon, Jr. | 175/107 X |
| 4,308,917 | 1/1982 | Dismukes | 166/381 |
| 4,406,332 | 9/1983 | Dismukes | 175/107 |
| 4,436,168 | 3/1984 | Dismukes | 175/107 |

*Primary Examiner*—Stephen J. Novosad
*Assistant Examiner*—Thuy M. Bui

[57] ABSTRACT

Disclosed is an apparatus for installing casing and pipe in a lateral well or bore.

16 Claims, 12 Drawing Figures

CASING LATERAL WELLS

TECHNICAL FIELD

The invention relates to drilling and casing wells and bores. More specifically, it relates to the placement of a casing in horizontal bores. Some of the means and methods disclosed also may be used to bore lateral wells.

RELATED APPLICATIONS

The following patent applications are related:

1. Ser. No. 933,272, filed Aug. 14, 1978, title, Buoyant Umbilical, now abandoned.
2. Ser No. 207,798, filed Nov. 17, 1980, title, Rotary Earth Boring Tool, or continuation in part of Ser. No. 948,081, filed Oct. 2, 1978 , now U.S. Pat. No. 4,406,332.
3. Ser. No. 265,997, filed May 21, 1981 title, Tubulars for Curved Bore Holes, now U.S. Pat. No 4,484,641.
4. Ser. No. 304,098, filed Sept. 21, 1981, title Apparatus and Method for Forming Lateral Passageway.
5. Ser. No. 339,001 Filed Jan. 12, 1982, title Thrust Generator for Boring Tools, now U.S. Pat. No. 4,436,168.

BACKGROUND ART

Lateral bores and wells are used to:

1. Create a drainage point at some distance from a central location;
2. Open a lengthy section of a formation to flow;
3. Provide for fluid injection;
4. Heat large volumes of the earth; and
5. Form part or all of a flow path to another well.

A preferred method of boring and casing lateral bore holes, which do not slant from the point of origin, is described below. Using standard drilling equipment and beginning with a vertical, or nearly vertical, well, the hole is deviated in a desired direction in such a way that it is an angle of say 45 degrees from vertical when it approaches the stratum where a horizontal bore hole is required. A usual casing string is set and cemented and the shoe is drilled. Angle gain is increased to some predetermined quantity and drilling a curved hole is continued until it becomes horizontal in the desired stratum. The more acutely curved part of the hole may be underreamed to increase its diameter by some 20 to 40 percent to accommodate more readily the passage of a larger casing and a more powerful drilling device as described later. The drilling apparatus for a small radius of curvature bore hole is then set aside and that for a straight hole is assembled.

Steel pipe normally is used as casing in deviated wells. However, the weight and lack of flexibility of steel pipe used with conventional drilling equipment severely limits the usefulness of steel casing in long lateral wells or in highly curved bore holes. Likewise, steel pipe usage creates similar problems in the drilling of lateral wells. As indicated below, various attempts have been made to improve the art of lateral well usage in hydrocarbon recovery.

The U.S. Pat. No. to Grable 4,024,913, describes a high strength, light weight, non-metallic material which may be used in making oil tubulars.

The U.S. Pat. No. to Jeter 3,893,523, discloses a drill string which may be curved. It is made of two or more coaxial members.

The U.S. Pat. No. to Allen 3,055,424 shows a tubular shaft comprised of a plastic middle member and top and bottom members of metal.

The U.S. Pat. No. to Hennigh 2,650,314, discloses that outwardly bowed spring centralizers in contact with the walls of a bore hole to restrain rotation of a motor housing.

The U.S. Pat. No. to Driver 4,227,584, shows a plurality of electric motors motors with their shafts connected by flexible couplings V. P. Singh, et al, wrote "The Flow of Sand/Water Slurries In Horizontal Pipes With Internal Spiral Ribs—Effect of Rib Height." It appeared in *The Canadian Journal of Chemical Engineering,* Vol. 54, Aug., 1976. C. A. Shook's article "The Effect of Line Length for Inclined Slurry Pipelines at Shutdown" was reported in *The Canadian Journal of Chemical Engineering,* vol. 53, Dec., 1975. In *World Oil,* Dec. 1978. Anderson and Hutchison report on "How to Efficiently Wash Sand From Deviated Well Bores."

Methods of boring small radius lateral bore holes from vertical wells are disclosed in the U.S. Pat. No. to Holbert 3,398,804 and to U.S. Pat. No. to Jeter 4,007,797. Such sharply curved holes have two distinct disadvantages: firstly, a casing is difficult to run and secondly, the distance that can be drilled with directional control is limited.

SUMMARY OF THE INVENTION

The present invention discloses the use of casing advancing means to install pipe such as casing in a lateral well. The advancement means may be actuated by a retractable prime mover located inside the casing. In one embodiment the advancing force is developed by a marine screw propeller means which may have cutting elements on, or ahead of, it to remove mud cake, cuttings or formation material which could inhibit casing advance. Such a device also would have the capability of pulling the pipe into a well or of drilling a bore hole.

The prime mover which rotates the propeller is spaced inside the casing and is releasibly connected thereto by a shaft which can conduct drilling fluid from the casing to water courses in the propeller or drilling tool. Several benefits result. An electric motor is cooled more effectively. A hollow rotor shaft is unnecessary, thus a standard motor may be used. The prime mover may be removed when the casing becomes reaches setting depth. After total depth is reached, casing may be left in situ and cemented without making an additional round trip with its attendant hazards.

The instant invention also involves novel means for cleaning cuttings and other debris from a bore hole either while drilling or while running casing. In one embodiment selection of casing material is desired. Desired physical characteristics of a casing for a lateral well include a density similar to the density of the drilling fluid in use and low tensile and flexural moduli all of which act to reduce drag forces when running in the hole. With casing and drilling fluid density nearly equal, gravity drag is minimized. Low flexural modulus equates with reduced minimum bending radius which creates smaller forces against the wall of a curved bore hole. Also, tension in the outer section of the casing caused by the advancing means tends to pull the casing away from bore hole wall contact in a curved section of the hole.

According to another feature of the present invention to improve cuttings removal during casing installation helical ribs may be fastened to the outside of the casing. Such ribs cause the return mud flow to continue its rotary movement initiated by a rotating propeller or drill bit and also provide a sweeping action at an angle to the bore hole axis which removes cuttings which might have settled to the low side of the horizontal hole. For additional hole cleaning other steps may be employed. These include using a casing only somewhat more dense than the drilling fluid so that the pipe lies lightly on the low side of the hole. Denser cuttings will collect at the casing bore wall contact. Such casing then may be lifted from tne low side of a lateral hole by occasionally circulating a slug or pill of drilling fluid of lower density throught the pipe. As the lower density slug flows outwardly, the casing will be buoyed upwardly to the top side of the horizontal hole by the annulus fluid and the increased fluid flow at low side of the hole will carry away deposited drill cuttings. Or, the casing may be constructed of material of lower density than the drilling fluid being circulated whence the casing always will float toward the top of a horizontal hole. Denser cuttings, which tend to settle, will be swept along by a faster mud flow alone the lower side of the bore hole. Alternatively, a casing somewhat more dense than the drilling fluid and equipped with helical ribs may be rotated slowly to scrape the low side of the bore hold to re-suspend drill cuttings.

BRIEF DESCRIPTION OF THE DRAWINGS

For a detailed description of the present invention, reference is made to the accompanying drawings in which.

DETAILED DESCRIPTION

Figure 1:
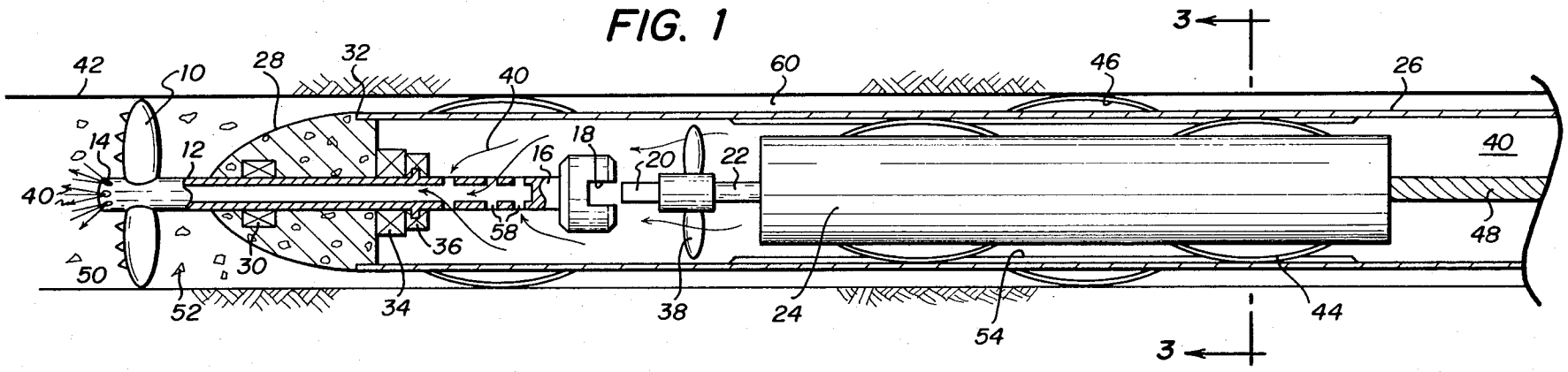
FIG. 1 is an elevation view partially in section of one embodiment of the casing puller of the present invention.

Referring now to the drawings where like reference characters refer to like or corresponding parts throughout the several views there is shown in FIG. 1 one embodiment of an electrically powered unit of the present invention used to assist in running casing in a horizontal well. A marine screw propeller 10 is shown fixed to a hollow shaft 12 having a watercourse 14 in its nether end. The near end 16 of the shaft 12 has slot 18 which accepts the drive end 20 of rotatable motor shaft 22 of electric motor 24. Casing 26 is fitted with casing guide shoe 28 modified to have rotary bearing 30 fixed to its nether end to accommodate shaft 12. The near end of shoe 28 is fitted with rotary bearing 34 and thrust bearing 36 to transmit the advancing force of rotating propeller 10 to casing 26. Propeller 38 serves to advance motor 24 inside casing 26 and to maintain shaft 22 in working connection with socket 18, if the frictional drag of outwardly flowing drilling fluid 40 is insufficient to do so when circulation is maintained. Ports 58 bored in hollow shaft 12 permit drilling fluid 40 to be pumped from casing 26 through shaft 12 and watercourse 14 into the casing-bore hole annulus 60 to wash cavings or debris 52 from hole 42. Centralizers 44 maintain the axis of motor 24 essentially in alignment with the axis of casing 26 while providing a low friction sliding contact with the casing wall. Centralizers 44 may employ a low friction contact surface such as Teflon or nylon. Casing 26 may be fitted with centralizers 46 for alignment purposes. Cable 48 can comprise electrical conductors and a steel core for tensional and torsional strength, needed when pulling motor 24 from bore hole 42. The cable can be enclosed in a soft and low friction cover so that cable 48 will not cut casing 26 when pulling motor 24. It is preferred that cable 48 also be twist resistant to absorb counter torque developed by motor 24.

Figures 2, 5, 6, 7:
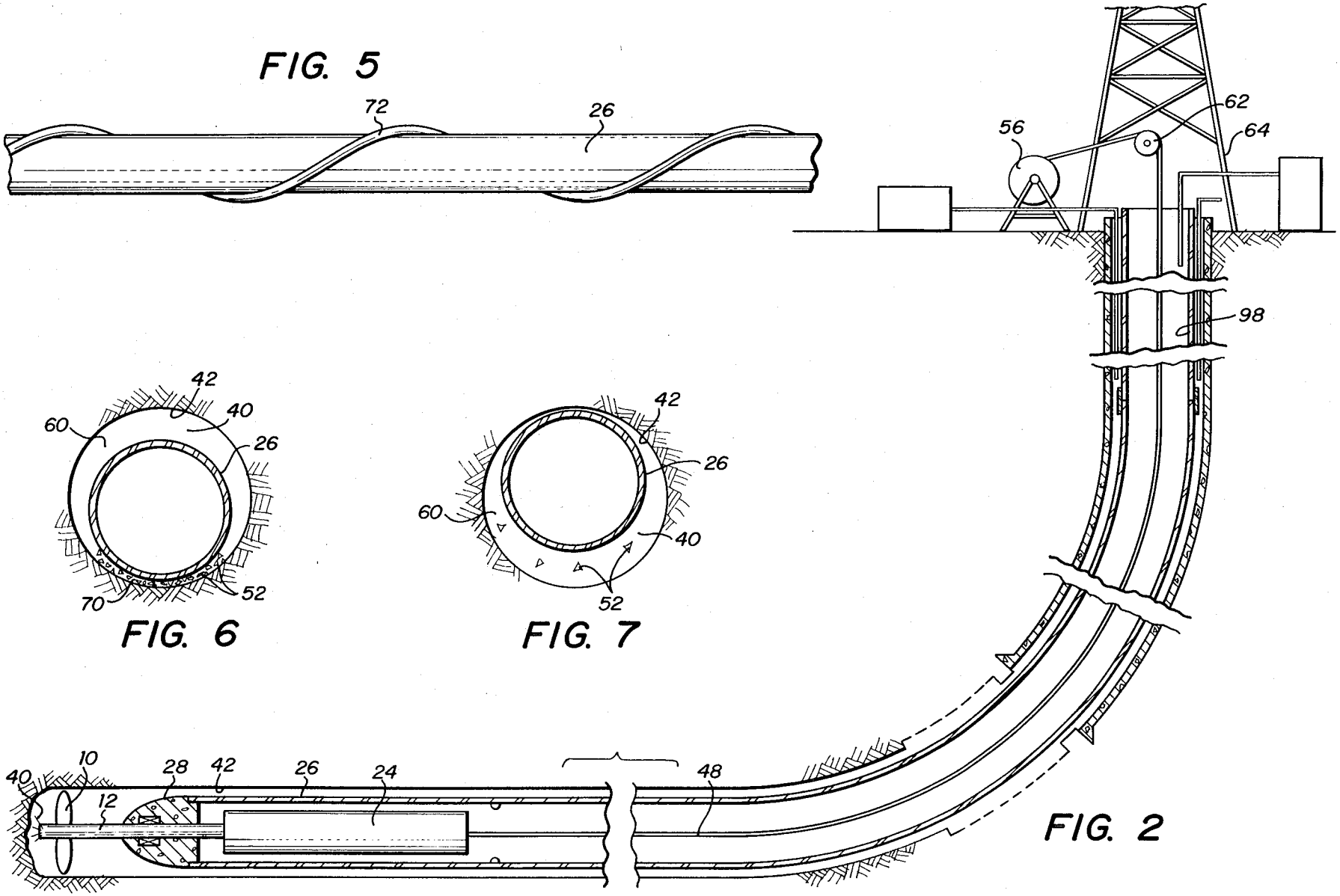
FIG. 2 llustrates an elevation view of the horizontal well with the present invention installed therein.
FIG. 5 is an elevation view of a section of casing constructed and accorrding to the present invention.
FIGS. 6 and 7 are sectional views of casing in a horizontal base.

Cable 48 and motor 24 may be removed by tensioning cable 48 using hoist 56 and sheave 62 as seen in FIG. 2. The latter is mounted in derrick 64. Thus, motor 24 and cable 48 may be pulled and rerun when it becomes necessary to add more casing 26 to that already in bore hole 42, especially in shallow wells. Alternatively, the cable deployment system described in U.S. Department of Energy report BETC-4033.3, Electrodrill System, Phase II, may be used.

Figure 3:
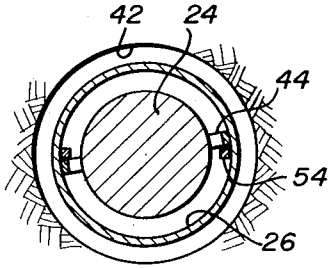
FIG. 3 is a sectional view taken on line 3—3 of FIG. 1 looking in the direction of the arrows.

As can be seen in FIG. 3, the reactive torque of motor 24 is transmitted to casing 26 by centralizers 44 which are prevented from rotating by contacting ribs 54 fixed to the interior of casing 26 in the outermost section of the casing.

Figure 4:
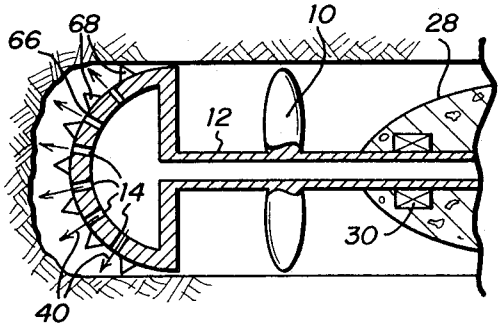
FIG. 4 illustrates a partial section of an alternate embodiment of the present invention.

In FIG. 4, an alternate embodiment is shown with a drill bit 66 bearing cutting elements 68 mounted on an extension of shaft 12. Drilling fluid 40 is ejected through watercourses 14 in bit 66 to keep the hole clean. It should be understood that a drilling tool may be placed outwardly of the propeller to assist in the advance of the casing in an open bore even when no actual new bore hole extension is anticipated.

After casing 26 has reached its final depth, motor shaft 20, motor 24, centralized 44, propeller 38 and cable 48 can be withdrawn from the casing. A customary two-plug primary casing cementation then may be carried out with the slurry exiting the casing through ports 58, hollow shaft 12 and watercourses 14.

In FIGS. 5–7, another aspect of the present invention is shown. This aspect has special application when drilling an essentially horizontal well using a downhole rotary prime mover situated inside a string of pipe to be left in the well as casing. In this application, heavier drill cuttings 52 will tend to collect in crevice 70 formed between pipe 26 and bore hole wall 42 as shown in FIG. 6. In some cases rotation of pipe 26 may dislodge cuttings 52. However, pipe rotation may destroy the sealing effectiveness of a mud filter cake and possibly cause differential sticking, particularly if pipe 26 is made of steel.

To demote this problem, a helical rib 72 can be fixed to the exterior of pipe 26 to cause the annular, or return, flow of drilling mud 40 to take a rotating path around pipe 26. This path will increase effective mud flow velocity and aid in the removal of drill cuttings. As shown rib 72 will direct fluid flow under pipe 26 at an angle to the pipe axis to assist in washing accumulated cuttings from crevice 70. Rib 72 may prevent pipe 26 from contacting the wall of bore hole 42 and thus enlarge crevice 70. Ribs 72 permit rotation of pipe 26 to be carried out more safely and effectively.

Figure 8:
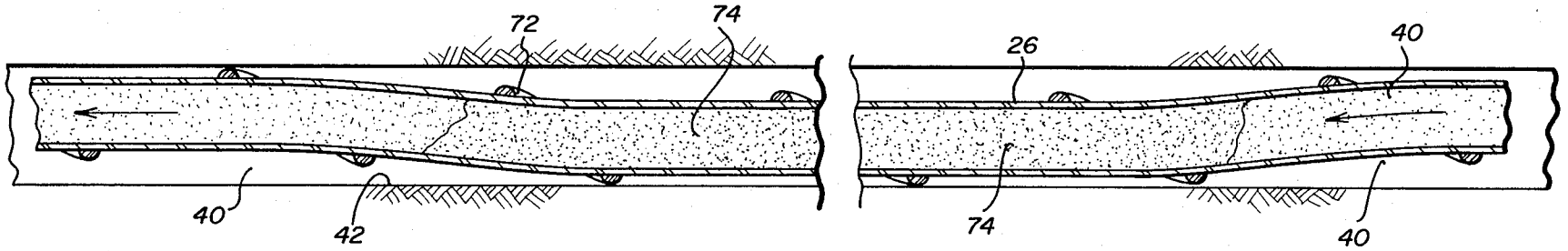
FIG. 8 is a partial sectional view of casing in a horizontal bore.

When a casing 26 is made from a material less dense than drilling fluid 40, it will be buoyed, or floated, to the upper side of lateral borehole wall 42 as shown in FIG. 7. Cuttings 52, being more dense than drilling fluid 40, still may have a tendency to settle. However, the cuttings will descend into a rapidly moving stream of drilling fluid rather than into a stagnant crevice area and are more likely to be transported out of the bore hole. A low density casing also may be fitted with a helical rib to improve drilling fluid velocity and direction. If it should be desired that rib 72 wipe the lower side of bore hole 42 to further remove drill cuttings, the density of circulating drilling fluid 40 inside pipe 26 may be increased sufficiently to cause rib 72 to contact the lower side of bore hole 42 while rotating pipe 26 slowly. FIG. 8 shows a pill of dense mud 74 which causes pipe 26 to sink with rib 72 in contact with bore hole wall 42. Examples of commercially available conduit having a density in the general area of 10 pound per gallon drilling mud are: Dayco Corp. of Dayton, Ohio, 45401, Product Series 7349 and 7293, and Aeroquip Corporaton, Jackson, Mich., part numbers 2560-96 and 2560-7.

Figure 9:
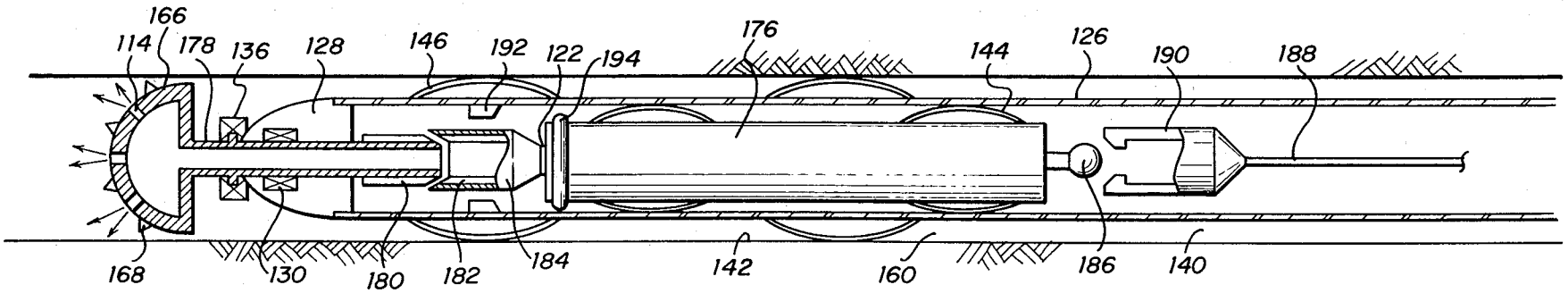
FIGS. 9 and 10 are an alternative embodiment of the present invention.

In FIG. 9, another embodiment is shown having a hydraulically powered prime mover 76 spaced inside casing 26. Commercially available hydraulically powered units include the Dyna Drill of Smith International, Inc. of Irvine, Calif., 92713 and motors of Neyrfor Turbodrilling Co., Inc. of Burlingame, Calif., 94010.

At the surface the nether end of casing 126 is fitted with bit 166 carrying cutting elements 168, a casing guide shoe 128 modified to include a thrust bearing 136 and rotary bearing 130 and shaft 178 fixed to bit 166 to extend through shoe 128 into casing 126. Shaft 178 is fitted with splines 180 to engage a mating female member 182 fixed to an extension 184 of rotor 122 of hydraulic motor 176. The motor 176 can be selectively seated in landing stage 192.

In operation, a casing 126, fitted out as described immediately above, is run into a bore hole to a desired depth, or until it meets a resistance to further advance which may be an obstruction in the bore hole or the end of the hole. Hydraulic motor 176 is fitted with a fishing connection 186, is run into the hole on a sand line 188 and releasable overshot 190. Alternatively, it may be pumped into position in a manner well known in the industry. Seating ring 194 is spaced to engage landing stage 192 only after splines 180 have been mated with member 182. It is to be understood that casing 126 can be centered in borehole 142 by means 146. Prime mover 176 may be spaced in casing 126 by means 144 such that drill bit 166 will advance along a line which is an extension of the axis of casing 126.

Figure 10:
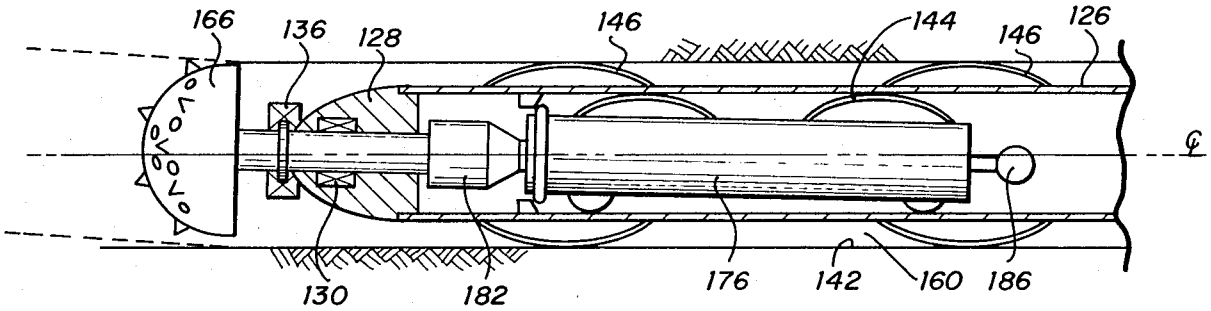

Alternatively, as shown in FIG. 10, the axis of prime mover 176 may be set at an angle to the axis of pipe 126 which then will cause bit 166 to advance at an angle to the pipe axis. When a lateral pipe 126 is turned, bit 166 may be caused to advance in an upwardly, a downwardly or in a sidewise direction, or it may follow any desired course in a deviated well. As shown by the dashed lines in FIG. 10, an upward path would be drilled in the configuration shown. However, if pipe 126 were turned 180 degrees, the path would be downward. Various survey instruments are available in the art to determine hole angle and direction. A generally straight lateral well may be bored by cocking motor 176 at a small angle to pipe 126 and by twisting pipe 126 slowly, or occasionally, through 360 degrees as the drilling progresses. The resulting well can have the form of a gentle spiral.

When the advance of pipe 126 is complete, wireline overshot 90 may be run to engage fishing connection 186 to pull female member 182 and prime mover 176 from the well. Casing 126 then may be cemented. Cement slurry will follow the path formerly taken by drilling fluid, that is, through hollow shaft 178, bit 166 and watercourses 114 to fill the annulus 160.

Figure 11:
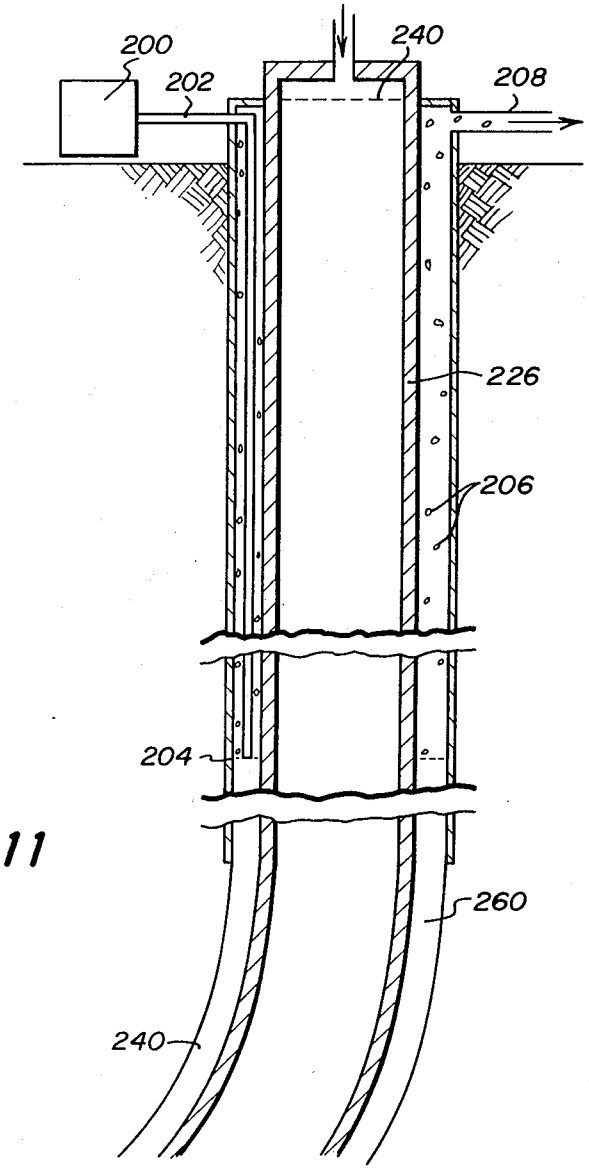
FIG. 11 illustrates a mud-level in a well in accordance with the method of the present invention.

Pipe 126 or casing 26 (FIG. 2) may be advanced by the weight of the pipe 98 as shown in FIG. 2. A first section of the pipestring is formed of pipe 98 which extends substantially through the vertical part of hole 42 and which is coupled by a coupling (unnumbered) to a second section of pipe 126 or casing 26 which, in turn, extends into the horizontal part of hole 42. Pipe 98 is comprised of high density (i.e. weight) conduit while pipe 126 or casing 26 is comprised of a lower density material. It can be seen that the weight of section 98 will transmit a compressive force onto pipe 126 or casing 26 to aid in pushing the respective conduit string into hole 42 to aid the tensional force being applied to the nether end of said conduit string by the thrust generating means, i.e. propeller 10 (FIGS. 2 and 4). An alternative method of applying an advancing force to casing 226 and drill bit 166 will result from maintaining the level of drilling fluid 240 higher inside casing 226 than it is in annulus 260 as shown in FIG. 11. Air-lift is one method of lifting annular drilling fluid in order to reduce hydrostatic or dynamic fluid head in the annulus at depth. Compressed air form source 200 is injected through tubing 202 which extends downward in the annulus to the depth 204 where lifting is to begin. Air bubbles 206 lower the columnar density of the drilling fluid which exits the annulus 260 through conduit 208. Thus, substantial advancing forces can be developed at the nether end of the casing. For example, a string of $10\frac{3}{4}$ inch casing can have an internal area of 78 square inches. If the effective fluid level of annulus drilling fluid having a columnar density of 50 psi per 100 feet is lowered 100 feet, the advancing force acting on the nether end of the casing is 3900 pounds. It is to be understood that flow restrictions around or near the prime mover must be sufficient for the difference in fluid levels to exist.

Figure 12:
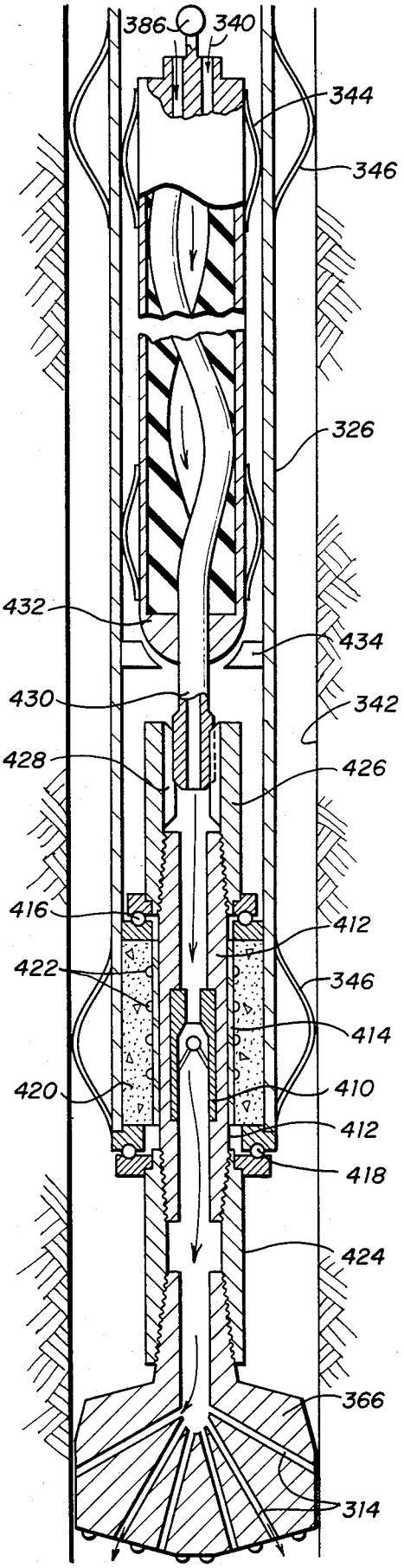
FIG. 12 is an alternative embodiment of the present invention.

When running a string of casing in a well the situation may arise where it would be beneficial to be able to float the casing both before and after drilling out an obstruction. The instant embodiment contemplates fixing a float collar such as the Halliburton Services Company, Duncan, Okla., product "Differential Fill Float Collar or Shoe" rotatably inside the casing as part of a drive shaft system connecting a hydraulic prime mover with a rotary drilling tool. The Halliburton tool may be circulated at any time without affecting the fill-up unit. Thus the drilling fluid which actuates a prime mover, such as the Dyna Drill, will pass through the Float Collar and the drilling tool outside the casing to be returned to the surface via the casing/bore hole annulus. FIG. 12 shows bore hole 342 with casing 326 spaced inside by means of centralizing means 346. Fixed inside the nether end of casing 326 is float collar 410 set inside tubular sleeve 412 which in turn fits rotatively inside low friction sleeve 414. Sleeve 414, which may be comprised of a material such as Teflon, and tube 412 are prevented from vertical movement by upper thrust bearing 416 and lower thrust bearing 418 while being free to turn with respect to casing 326. Sleeve 414 is centralized in casing 326 by means of a grout 420 and prevented from movement therein by means of protuberances 422. The nether end of tube 412 is threadably connected to a collar, or bit sub 424, which in turn carries rotary tool 366 fitted with watercourse 314 through which drilling fluid 340 may pass. The upper end of sleeve 412 is fitted with collar 426 to which is fixed female mating tool 428 which will engage shaft 430 of hydraulically powered motor 432 such that activation of motor 432 will cause rotary tool 366 to turn. Stop 434 prevents motor 432 from penetrating too deeply into tool 428 while at the same time causing the flow of drilling fluid 340 to pass through the hydraulic motor 432 as shown by arrows. The flowing pressure differential across motor 432 holds it firmly in place when fluid is circulated. The Dyna Drill normally is fitted with a by-pass or dump valve assembly which will allow equalization of drilling fluid pressure above and below the motor. A wireline overshot connected to fishing knob 386 thus can pull motor 432 from the casing when the motor no longer is required. Of course, tool 366 remains in place below casing 326. If casing 326 is an intermediate string and additional drilling is to be carried out, the various devices, collars, shafts, grout, drill bit and sleeves, may be made of drillable materials such as, cast iron, cast aluminum, concrete and plastics.

What is claimed is:

1. A system for overcoming a resistance to advance of a pipe string in a well bore at least partly filled with drilling fluid comprising:

a. A rotary prime mover releasably mounted inside the nether end of said pipe string;

b. A marine screw propeller means spaced outside of, and beyond, said pipe string; and c. Means interconnecting said prime mover and said propeller whereby said propeller may be rotated by said prime mover to provide an advancing force acting on said pipe string.

2. Claim 1 including cutting elements connected to said propeller means.

3. Claim 1 wherein said prime mover is electrically powered.

4. Claim 1 including means for circulating said drilling fluid through said propeller means.

5. Claim 1 including a drilling tool spaced beyond said propeller means.

6. A system for overcoming resistance to advance of a pipe string in a curved section of a bore hole by reducing the intensity of the force of the contact of the bent pipe against the outer bore wall comprising:

a. A thrust generating means spaced at the nether end of said pipe string; and b. Means for transmitting said thrust as a tensional force to pull on said pipe string thereby to reduce the wall-contacting force in said curved bore hole.

7. A system for applying an advancing force to a pipe string in a substantially horizontal bore hole depending from a more vertical well bore comprising:

a. A pipe string composed of two sections, a low density section in the horizontal bore hole and a high density section in the vertical bore hole;

b. Means for transmitting the weight of said high density pipe section to said low density section thereby creating a compressive force therein; and c. Means for creating a tensional force at the nether end of said low density pipe section.

8. The system of claim 7 wherein said means for creating a tensional force comprises:

a shaft extending from the nether end of said low density pipe section;

a marine screw propeller mounted on said shaft; and means within said low density pipe section for rotating said shaft.

9. A system for advancing a pipe string into a bore hole which is at least partially filled with a liquid, said system comprising:

a pipe string extending into said bore hole from the surface;

a rotary prime mover adapted to be lowered from the surface or raised to the surface through said pipe string; said rotary prime mover including a rotary drive shaft;

a shaft rotatably journalled through the nether end of said pipe string; said shaft having an upper end within said pipe string and a lower end below said nether end of said pipe string;

means for releasably mounting said rotary prime mover inside said nether end of said pipe string when said prime mover is lowered therein;

means for releasably connecting said drive shaft of said rotary prime mover to said upper end of said shaft whereby said shaft is rotated by said drive shaft; and a marine screw propeller means affixed on said lower end of said shaft to be rotated within said liquid in said bore hole to provide an advancing force on said pipe string.

10. The system of claim 9 wherein said pipe string comprises a casing string.

11. The system of claim 9 wherein said pipe string comprises a drill string.

12. The system of claim 11 including a drilling tool affixed on said lower end of said shaft below said marine screw propeller means.

13. The system of claim 9 including:

a marine screw propeller affixed to said drive shaft to be rotated thereby to provide an advancing force on said rotary prime mover as it is lowered through said pipe string.

14. The system of claim 9, wherein said bore hole is curved and has a substantially horizontal bore hole section depending from a substantially vertical bore hole section and wherein said pipe string comprises:

a first section of pipe having high density section positioned in said vertical section of said bore hole; and a second section of pipe having lower density connected to said first section and positioned in said horizontal section of said bore hole whereby the weight of said high density first section is applied to said low density second section to create a compressive force therein.

15. The system of claim 9 wherein said rotary prime mover is an electric motor

16. The system of claim 9 wherein said rotary prime mover is a hydraulic motor.

* * * * *